United States Patent [19]

Zodrow

[11] 4,146,421

[45] Mar. 27, 1979

[54] LABELING STATION IN A LABELING MACHINE

[75] Inventor: Rudolf Zodrow, Dusseldorf, Fed. Rep. of Germany

[73] Assignee: Jagenberg-Werke AG, Dusseldorf, Fed. Rep. of Germany

[21] Appl. No.: 723,688

[22] Filed: Sep. 16, 1976

[30] Foreign Application Priority Data

Oct. 3, 1975 [DE] Fed. Rep. of Germany ..... 2544277

[51] Int. Cl.[2] ..... B65C 9/16; B65C 9/26

[52] U.S. Cl. ..... 156/560; 156/568; 156/571; 156/DIG. 14; 156/DIG. 32; 156/DIG. 42; 271/33

[58] Field of Search ..... 156/560, 567, 568, 571, 156/DIG. 13, DIG. 14, DIG. 32, DIG. 31, DIG. 42, 447; 271/33, 95, 115

[56] References Cited

U.S. PATENT DOCUMENTS

| | | | |
|---|---|---|---|
| 3,385,595 | 5/1968 | Bewatar et al. | 271/95 |
| 3,522,134 | 7/1970 | Von Hofe et al. | 156/568 X |
| 3,567,551 | 3/1971 | Dullinger | 156/560 X |
| 3,748,210 | 7/1973 | Beutl | 156/567 |
| 3,767,515 | 10/1973 | Eder | 156/568 |
| 3,865,671 | 2/1975 | Kronsder | 156/560 X |
| 4,032,388 | 6/1977 | Dunning | 156/568 |

*Primary Examiner*—Michael G. Wityshyn

*Attorney, Agent, or Firm*—Sprung, Felfe, Horn, Lynch & Kramer

[57] ABSTRACT

A labeling machine is provided to apply simultaneously two labels to different diameter portions of a bottle, e.g. the neck and belly. The structure for applying the belly label is conventional but above the usual affixing element there is provided a second affixing element which is operatively connected to a cam follower which senses a cam track opposite the labeling station. This causes the second affixing member to be projected radially outward at the time of label affixing so it reaches the narrow diameter portion of the bottle.

1 Claim, 1 Drawing Figure

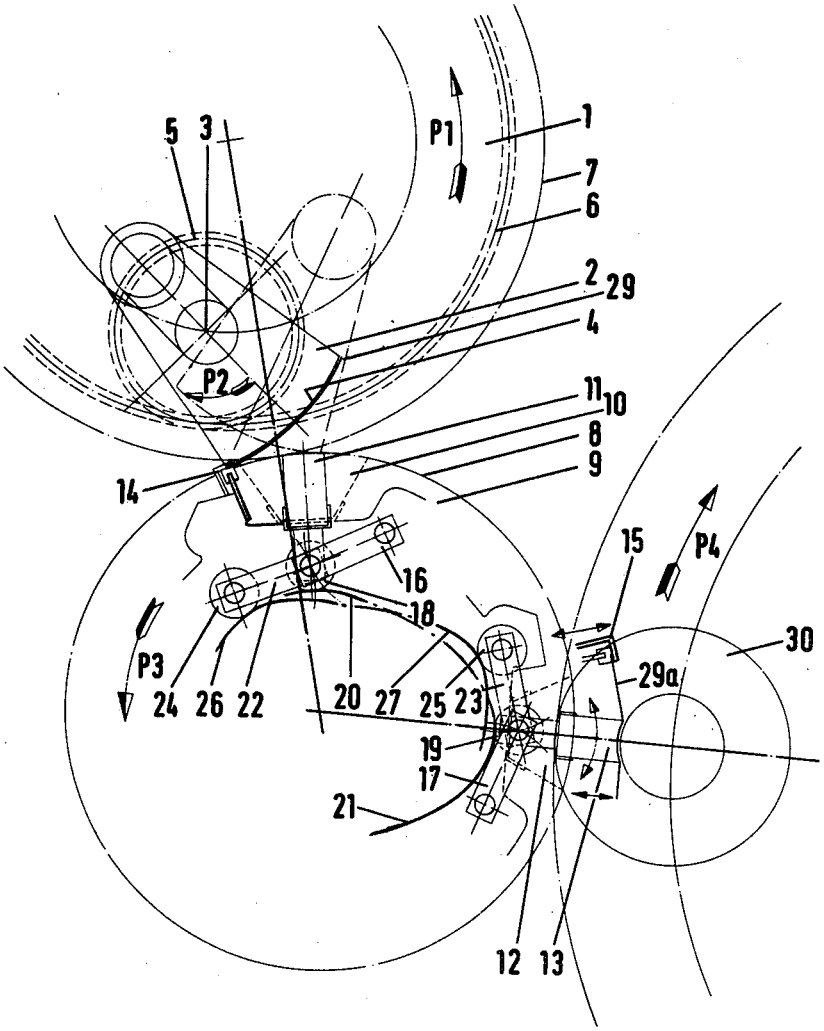
5
3
P1
1
7
6
2
29
4
P2
11
10
8
9
14
15
P4
16
18
30
P3
29a
24
26
22
20
27
25
23
19
17
21
12
13

LABELING STATION IN A LABELING MACHINE

The invention concerns a labeling station in a labeling machine with a revolving carrier on which is mounted eccentrically at least one gluing segment with a convexly curved receiving surface for a label and with a revolving label-transfer system, on which is mounted, eccentrically and in such a way that it may move in the circumferential direction, an affixing member with gripper elements, past which, as the device turns, the gluing segment moves as the label is transferred and the transferred label, as it moves past, is pressed against the object to be labeled, which revolves on its own axis and is advanced on a transport path.

In labeling machines, there are certain difficulties in affixing labels to the objects which are to bear them, inasmuch as it is not easy to achieve synchronism between the revolving object and the affixing means during the label-affixing operation.

This is especially true when bottles of varying diameters are to be labeled, as is the case when bottles are to be labeled simultaneously at belly and breast. In the case of a labeling station having gluing segments mounted eccentrically on the carrier and revolving about their own axes, such as described, for example, in the German "Offenlegungsschrift" 2,325,244, it is necessary, for achieving reliable picking up of the glue-coated labels by the gripper elements and the affixing members, that the said gripper members and affixing members move on the same arcuate path in the transfer region, both for the belly label and for the breast label, because the gluing segments are able to perform a rolling movement only along this path. The required rolling operation makes it necessary, furthermore, that the speed of movement of the gripper means and affixing members be matched to that of the gluing segments. This speed and the arcuate path, however, are not capable of assuring a rolling movement in the affixing of the labels to the surface of the bottle to begin with. The speed and the arcuate path are optimum with regard to the required rolling movement only for a single diameter of an object rotating at a certain rotatory speed. It is therefore necessary to adapt the speed of the gripper means and affixing members in the area where the labels are transferred to the object to the circumferential speed of the object. This adaptation is especially necessary when one and the same object is to be labeled simultaneously in the area of two different diameters. Whereas it is possible to adapt the circumferential speed and the arcuate path of the gripper means and affixing members to the circumferential speed of the bottle and to the transport path within this area for the label that is intended for the first diameter, e.g. the belly label, without thereby impairing the rolling action of the gluing segments, such adaptation is not possible for labeling the breast of the bottle or the neck of the bottle. In order to label the neck of the bottle, the affixing member would first of all have to be displaced further out in the radial direction. If the rotatory speed is the same for the affixing member which applies the belly label as it is for the affixing member which applies the breast label, this results in a higher circumferential speed; the circumferential speed of the breast or neck of the bottle, on the other hand, is lower than that of the belly of the bottle. Therefore, a still greater relative movement would take place between the affixing member and the breast or neck of the bottle.

In awareness of these difficulties, in a known machine the affixing member for affixing the label to the neck of the bottle affixes the label with a slapping movement, so that no rolling movement can occur. This slapping movement, however, not only is expensive to produce, but also does not guarantee the reliable affixing of the label (German Pat. No. 2,035,477).

In a different known machine for simultaneously labeling the neck and belly of the bottle, the affixing member for the belly label that, in contrast to the affixing member for the neck label, has a rate of movement different from the circumferential speed of the surface of the bottle, is mounted movably in the direction of the path against the force of a spring, in such a manner that, as it touches the bottle, it takes on its circumferential speed. With such a matching of speeds, it is disadvantageous that the affixing member must be accelerated by using the frictional contact between the surface of the flask and the label, whereby a relative movement cannot be avoided, especially at the beginning of the acceleration. In order to keep these disadvantages as small as possible, a further member, in addition to the affixing member, has been provided that leads the affixing member by a few degrees of angle, so that the affixing member, as it commences to touch the surface of the flask, already has approximately the circumferential speed of the flask (German "Offenlegungsschrift" 1,486,142).

THE INVENTION

The invention is addressed to the problem of creating a system which, for the purpose of guaranteeing the reliable affixing of labels, matches in a simple manner the circumferential speeds of the affixing member and the gripper element to the circumferential speed of the object to be labeled.

The problem is solved by providing at the surface of the the object to be labeled and in a mechanism of the type hereinabove described, a cam curve, surface or track for controlling the rolling movement of each affixing member, the curve being sensed by a feeler of the affixing member. A movement is forced upon the affixing member from the outside, whose circumferential speed on affixing corresponds from the beginning to that of the object to be labeled. The circumferential speed of the affixing member can be determined so accurately by the curve control, that there can be no relative movement between the object to be labeled and the affixing member, even in the initial phase of the rolling process.

According to one embodiment of the invention, different diameters of the object can be matched without displacing the point of rotation of the label transfer mechanism in relation to the transport path thereby that the affixing member can be pre-controlled in direction of the object to be labeled. The gripper elements, assigned to the affixing member, are advantageously pre-controlled in common with the affixing member, so that there is no excessive stress on the labels during pre-controlling.

The affixing member and, if necessary, the gripper element can be pre-controlled in a simple manner by means of a curve, on which the affixing member rests with a feeler.

In the following, the invention is illustrated in greater detail by means of the FIGURE, which represents schematically a portion of the labeling station in plan view.

The labeling station has a plate-shaped base 1, which turns in the direction of arrow P1. Eccentrically arranged on base 1, are several, spaced gluing segments 2, which turn about their own axes 3 in direction of arrow P2, in the opposite direction to the rotation of base 1. The axis 3 of each take-off element 2 lies between the convexly curved receiving surface 4 and its center of curvature. The drive of the gluing segments 2 takes place via a planet gear 5, 6, from which the planet pinion 5 rolls along the stationary sun wheel 6, as the base 1 turns. As the take-off element 2 turns, the receiving surface 4 crosses the outer circumference 7 of the plate-shaped base 1, in order to roll at the circle 8 of the label transfer mechanism, which is still to be described. So that this may take place without slippage, the rotation of the take-off element 2 is not uniform, but accelerated and retarded. For this purpose, a cam-controlled superimposing gear is provided, such as is described in detail, for example, in the German "Offenlegungsschrift" 2,325,244. This superimposing gear is not shown in the drawing.

As the base 1 turns, the take-off element 2 is thus moved past the label transfer mechanism 9. This mechanism has several, spaced affixing pads 10, 11, 12, 13 with associated gripper elements 14, 15. In the drawing, two affixing pads, 10, 11 or 12, 13, arranged one above the other, are provided of which the lower, 10, 12 is intended for the belly label and the upper 11, 13 for the breast label. The affixing pads 10, 12 for the belly labels are mounted stationary on the plate-shaped base, which turns in the direction of the arrow P3, of the label transfer mechanism 9. The affixing pads 10, 12 are arranged in such a way that that their convexly curved surfaces coincide with the circle 8, around which the gluing segments 12 are driven in the transfer domain. The upper affixing pads 11, 13 on the other hand, are mounted in such a manner that they can pivot, as well as be displaced in radial direction. For moving forward and pivoting, each affixing pad 11, 13 is respectively attached to a crank 16, 17, which carries a roller 18, 19 as feeler at that end which is free to swing. The shape of the curves 20, 21 determines the radial positions of the affixing pads 11, 13. For pivoting the affixing pads 11, 13, further lever arms 22, 23 are respectively provided, each of which is respectively joined at a fixed angle to its affixing pad 11, 13 and which senses a second cam surface 26, 27 with a further roller 24, 25.

The mode of operation of the inventive labeling station is as follows

The take-up surface 4 is coated with glue as the gluing segment 2 moves past a glue roller, which is not shown. During the subsequent rolling motion along the top label of a stationary label box, which is not shown, the top label 29 adheres to the glue-coated take-up surface 4 and, as the base 1 turns further, is transported to the label transfer mechanism 9. The number of gluing segments 2 and of affixing pads with gripper elements, as well as the rate of revolution of the base with the gluing segments and the label transfer mechanism, are so coordinated that an affixing pad is at all times opposite the gluing segment, whenever a gluing segment 2 passes by the label transfer mechanism 9. The curve control of the affixing pads ensures that the front sides of the affixing pads 10, 11 coincide with the arcuate path 8 during the transfer phase, so that the take-up surface 4 rolls off completely at the gripper elements 14 and the affixing pads 10, 11, with free transfer of the labels. When, as the label transfer mechanism 9 turns further, the labels, that have been taken up, reach the region of the bottles 30, which are being transported in the direction of the arrow P4, the upper affixing pad 13 moves radially outwards, as the roller 19 is supported on curve 21. As soon as the upper affixing pad 13 comes into contact with the breast of the bottle or the neck of the bottle, it pivots, depending on the shape of the curve 27, in such a manner that there is no relative movement between the circumferential speed of the breast of the bottle or the neck of the bottle and the surface of the affixing pad 13. As can be seen from the drawing, the affixing pads 12, 13, press against the bottle during the affixing operation, so as to adapt to its shape. The drawing indicates by an arrow that, together with the upper affixing pads 13, the associated gripper elements are also moved forward. This can be achieved by a rigid connection to the affixing pads 13, which is not shown.

It will be appreciated that the instant specification and examples are set forth by way of illustration and not limitation, and that various modifications and changes may be made without departing from the spirit and scope of the present invention.

What is claimed is:

1. In a labeling machine for articles such as bottles having larger and smaller diameter portions, the machine including a labeling station, a base rotatable about a first vertical axis, at least one gluing segment with a convexly curved label receiving surface, said segment being eccentrically mounted on said base for independent rotation, a label-transfer member rotatable about a second vertical axis, wherein the improvement comprises first and second affixing members eccentrically mounted about a vertical pivot axis on the label-transfer member for movement therewith in the circumferential direction the affixing members being axially aligned and vertically offset with respect to one another and having gripping elements connected thereto, means interconnecting the affixing members and the gluing segment so that the gluing segment moves past the affixing members to transfer labels thereto, and means responsive to the movement of the second affixing member in the circumferential direction for moving both the second affixing member and its associated gripper elements radially outward from the axis of the label transfer member towards the smaller diameter portion of the article and pivoting the second affixing member about its pivot axis to effect no relative movement between the contacting surface thereof and the article to be labeled concurrently with the contacting of a transferred label by the first affixing member to the larger diameter portion of the article, said means for moving comprising a first cam track opposite the labeling station, and a first cam follower operatively connected with said second affixing member and sensing said first cam track, whereby when said second affixing member reaches said labeling station it is caused by said first cam track and said first follower to be projected radially outwardly with its associated gripper elements so as to reach the smaller diameter portion of the article to be labeled, a second cam track opposite the labeling station, and a second cam follower operatively connected with said second affixing member and sensing said second cam track for pre-controlling the second affixing member to effect the pivoting movement thereof.

* * * * *